United States Patent [19]

Cooper

[11] 3,951,074

[45] Apr. 20, 1976

[54] SECONDARY LIFT FOR MAGNETICALLY LEVITATED VEHICLES

[75] Inventor: Richard K. Cooper, Hayward, Calif.

[73] Assignee: The United States of America as represented by the United States Energy Research and Development Administration, Washington, D.C.

[22] Filed: Sept. 27, 1974

[21] Appl. No.: 509,972

Related U.S. Application Data

[63] Continuation-in-part of Ser. No. 322,646, Jan. 11, 1973, abandoned.

[52] U.S. Cl. ..... 104/148 MS; 104/148 SS

[51] Int. Cl.[2] ..... B61B 13/08

[58] Field of Search ..... 104/148 LM, 148 MS, 104/148 SS; 308/10; 310/12, 13; 318/135

[56] References Cited

UNITED STATES PATENTS

| | | | |
|---|---|---|---|
| 3,158,765 | 11/1964 | Polgreen | 104/148 MS |
| 3,470,828 | 10/1969 | Powell | 104/148 SS |
| 3,589,300 | 6/1971 | Wipf | 104/148 SS |

*Primary Examiner*—Trygve M. Blix
*Assistant Examiner*—Reinhard J. Eisenzopf
*Attorney, Agent, or Firm*—Dean E. Carlson; F. A. Robertson; Clifton E. Clouse, Jr.

[57] ABSTRACT

A high-speed terrestrial vehicle that is magnetically levitated by means of magnets which are used to induce eddy currents in a continuous electrically conductive nonferromagnetic track to produce magnetic images that repel the inducing magnet to provide primary lift for the vehicle. The magnets are arranged so that adjacent ones have their fields in opposite directions and the magnets are spaced apart a distance that provides a secondary lift between each magnet and the adjacent magnet's image, the secondary lift being maximized by optimal spacing of the magnets.

9 Claims, 8 Drawing Figures

SECONDARY LIFT FOR MAGNETICALLY LEVITATED VEHICLES

The invention disclosed herein was made under, or in, the course of Contract No. W-7405-ENG-48 with the United States Atomic Energy Commission.

RELATED APPLICATION

This application is a continuation-in-part of copending U.S. Patent application (now abandoned) Ser. No. 322,646, filed Jan. 11, 1973, in the name of Richard K. Cooper.

BACKGROUND OF THE INVENTION

The invention relates to magnetic lift systems, and more particularly, it relates to increasing the total lift of a group of magnets by optimally spacing the magnets in a particular polarity arrangement.

Magnetic suspension of a high-speed vehicle is disclosed in U.S. Pat. No. 3,589,300, issued June 29, 1971, to Stefan L. Wipf, wherein the vehicle is propelled at a speed at which magnets that are carried by the vehicle are levitated along with the vehicle by repulsion of the magnets from mirror images resulting from eddy currents induced in a nonferromagnetic and continuous electrical conductor that defines a track for the moving vehicle. Each mirror image is, for practical purposes, directly opposite the magnet creating the image. A particular problem of magnetic lift systems, such as the Wipf system, for high-speed vehicles is the large weight-to-lift ratio of the magnets, particularly permanent magnets. For a practical magnetic lift system it is necessary to reduce the total weight to the point that a significant payload may be carried by the vehicle. One approach in maximizing the payload of a magnetically levitated vehicle utilizing permanent magnets opposite a nonferromagnetic and continuous conductor as a track is discussed by Richard K. Cooper, V. Kelvin Neil and Wayne R. Woodruff in Optimum Permanent-Magnet Dimensions for Repulsion Applications, IEEE Transactions on Magnetics, Vol. Mag.-9, No. 2, June 1973, pages 125–127. However, in both the Wipf patent and the Cooper et al paper, the magnetic lift discussed is primary lift, which is the lift only between each magnet and its directly opposite mirror image in a nonferromagnetic continuous electrically conductive track. Other publications regarding primary lift arrangements include a U.S. Pat. No. 3,470,828, issued Oct. 7, 1969, to J. R. Powell, Jr. et al, and U.S. Pat. No. 3,158,765 issued Nov. 24, 1964, to G. R. Polgreen. In the Powell patent a complex track consisting of a plurality of electrically conducting loops is disclosed, while in the Polgreen patent a complex track including long lines of permanent magnets is disclosed. However, in neither the Wipf Powell or Polgreen patents nor the Cooper et al paper, is there any discussion or recognition of a secondary lift effect. Any secondary lift effect of a high-speed vehicle that does not require added weight would provide a more favorable weight-to-lift ratio.

SUMMARY OF THE INVENTION

In brief the invention is the discovery that a plurality of magnets may be arranged so that significant repulsive forces between parallel magnetic moments (or attractive forces between antiparallel moments) exist and can be utilized. One application of this discovery is in a system for levitating a high-speed terrestrial vehicle by means of a series of magnets mounted beneath the vehicle for inducing, in a nonferromagnetic continuous electrically conductive track, eddy currents which repel the inducing magnet to provide primary lift for the vehicle. According to the invention, significant secondary lift for the vehicle may be provided by arranging adjacent magnets to have their fields in opposite directions and to be spaced apart an optimum distance at which there is a maximum repulsive force between each magnet and the magnetic field produced by eddy currents due to each immediately adjacent magnet.

It is an object of the invention to provide secondary lift to a magnetically levitated vehicle by arranging adjacent magnets to have their fields in opposite directions and by optimally spacing the magnets.

Another object is to lower the weight-to-lift ratio of a magnetic levitation system.

Another object is to provide an arrangement in which permanent magnets are practical for use in a magnetic levitation system.

Other objects and advantageous features of the invention will be apparent in a description of a specific embodiment thereof, given by way of example only, to enable one skilled in the art to readily practice the invention, and described hereinafter with reference to the accompanying drawings.

DESCRIPTION OF AN EMBODIMENT

Figure 1:
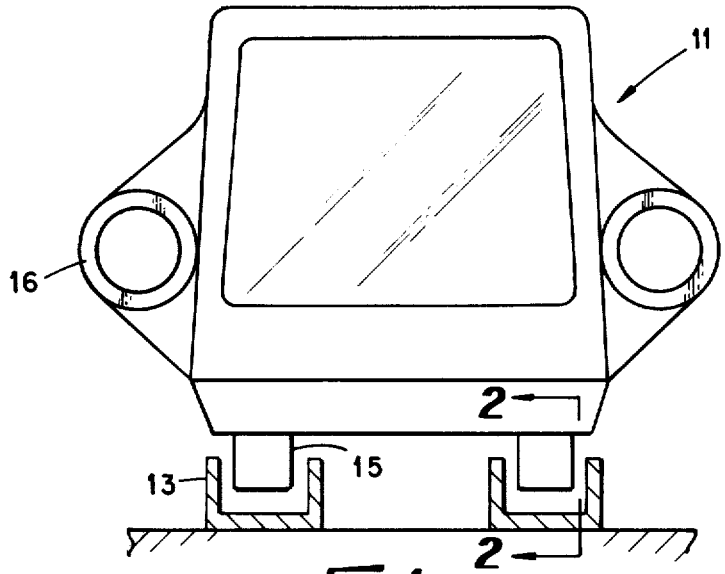
FIG. 1 is a pictorial view of the front of a high-speed vehicle that is magnetically levitated according to the invention.

Referring to the drawing there is shown in FIG. 1 a high-speed terrestrial vehicle 11 such as a train, that is levitated above a pair of tracks 13 by means of a plurality of magnets 15 mounted beneath the vehicle. The magnets 15 may be either permanent magnets or electromagnets including cryogenic magnets (magnets having windings of normal metal and operated at a cryogenic temperature) and superconducting magnets (magnets having windings of superconductor metal and operated at a cryogenic temperature and usually carrying a steady current). The tracks 13 are made of a continuous nonferromagnetic electrically conductive material so that as the vehicle is propelled, such as by jet engines 16, and reaches a high speed, eddy currents are induced in the track by the moving magnetic fields of the magnets 15. The eddy currents set up magnetic fields which are directly opposite and which repel magnets 15, resulting in a primary lifting force that lifts the vehicle 11 from the track. The induced fields in the electrically continuous track appear to move directly opposite and with the inducing magnet.

Significant secondary lift for the vehicle 11 is provided, according to the invention, by arranging adjacent inducing magnets 15 to have their fields in opposite directions and to be spaced apart an optimum distance such that there is a maximum repulsive force between each magnet and the eddy currents induced in the track by the adjacent magnet.

Figure 2:
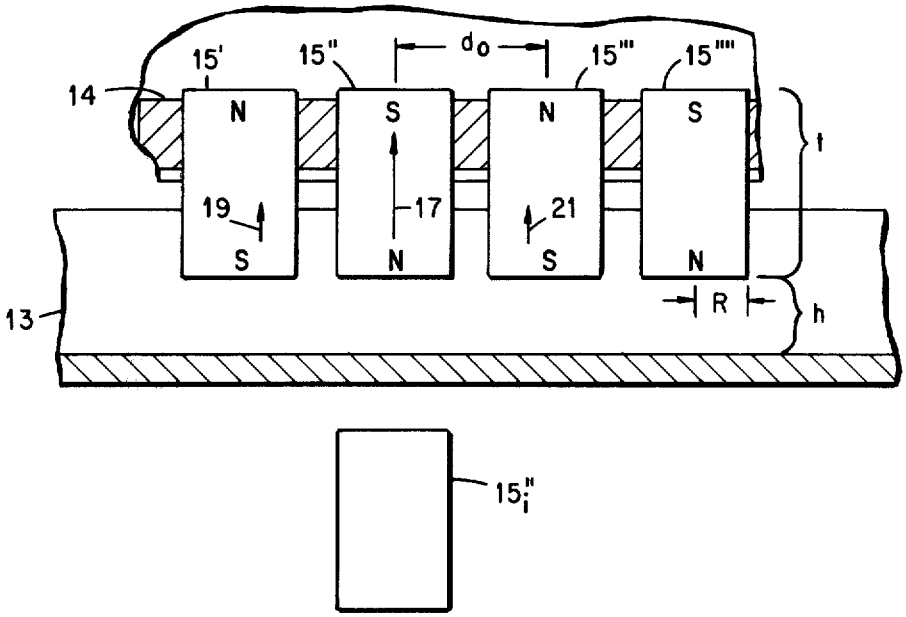
FIG. 2 is a diagrammatic view taken along lines 2—2 of FIG. 1 of a group of magnets arranged to provide secondary lift as well as primary lift for the vehicle of FIG. 1.

Referring to FIG. 2, a view is shown taken along line 2-2 of FIG. 1 of a representative group of the magnets 15 while they are levitated above the lower part of the track 13 which is shown in cross section. The group includes magnets 15', 15'', 15''', and 15'''', which are suitably secured to the vehicle 11 such as by mounts 14 which may double as keepers between adjacent magnets. The magnets are arranged so that the field of each magnet is in an opposite direction with respect to the adjacent magnet. For the purpose of analysis, the interaction between the magnets and the induced eddy currents can be qualitatively discussed in terms of image magnets even though this is a concept that is rigorously valid only for tracks which are flat and extend beyond the edges of the magnets a very great distance. The apparent location of the induced image of each vehicle magnet at speeds in excess of 100 MPH is essentially directly beneath the inducing magnet and spaced beneath the surface of the track a distance equal to the distance the magnet is spaced above the surface. For the purposes of the present discussion only one image, image $15_i''$, which is the image of magnet 15'', is shown in FIG. 2. Primary lift of the magnet 15'' is the total repulsive force in the vertical direction between the magnet 15'' and its image $15_i''$ and is represented by a vector 17. However, by optimumally spacing the magnets 15' — 15'''' apart a distance $d_o$, additional or secondary lift may be provided each magnet due to a repulsive force between each magnet and the images of the adjacent magnets. The secondary lift exerted on the magnets 15' and 15''' by the image pole 15'' are represented by the vectors 19 and 21, respectively.

Figure 3:
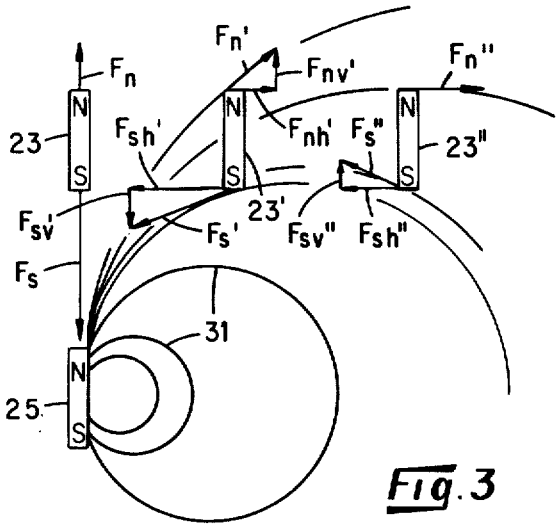
FIG. 3 is a diagram of a pair of magnets and shows assumed vector representations of the forces between the magnets as their horizontal separation is increased.

The presence of this secondary lift may be conceptually illustrated in FIG. 3 in which a first magnet 23 is shown directly above a second magnet 25, the magnet 23 being analogous to the magnet 15''' and the magnet 25 being analogous to the image pole $15_i''$. A total vertical force $F_v$ acts on the magnet 23 which is the sum of the vertical components of a force $F_n$ acting on the north pole and a force $F_s$ acting on the south pole. With the magnets 23 and 25 coaxially aligned, their horizontal separation is zero so that the forces $F_n$ and $F_s$ have zero horizontal components and consist entirely of vertical components. In this position of the magnets the total vertical force is attractive and at a maximum. When the magnet 23 is moved rightward and away from magnet 25 at a constant height to successive positions, such as positions 23' and 23'', it may be observed that there are horizontal and vertical components of the polar forces which are functions of the horizontal distance $d$ between the magnets. The total vertical force $F_v$ acting on the magnet 23, therefore, also is a function of the distance d and is sketched as a curve 27 in FIG. 4. When the magnet 23 is directly over the magnet 25 the force $F_v$ is maximum, attractive and corresponds to a point 29 on curve 27. As the magnet 23 is moved rightward and away from the magnet 25, the forces at the poles of the magnet 23 tend to be in a direction that is tangent to magnetic lines of force 31 emanating from the magnet 25. It should be noted that the FIG. 3 is explanatory only and is not meant to be a complete and accurate representation of true field lines; it is however, representative of the repulsive effect of opposite poles at certain horizontal separations. Thus, as the lines 31 curve away from the magnet 25, the force at each pole of the magnet 23 tends to follow the lines tangentially and to thereby change direction. The change of direction causes the vertical component of the forces $F_s$ and $F_n$ to lessen, particularly the vertical component of the force $F_s$ since the south pole of magnet 23 is closer to the north pole of magnet 25 than the north pole of magnet 23 is to the south pole of magnet 25. As the magnet 25 is moved rightward, a position such as the position 23' will be reached at which there is a force $F_s'$ at the south pole of the magnet, having a horizontal component $F_{sh}'$ and a vertical component $F_{sv}'$. At the north pole of the magnet there will be a force $F_n'$ having a horizontal component $F_{nh}'$ and a vertical component $F_{nv}'$. The vertical components $F_{sv}'$ and $F_{nv}'$ are equal in magnitude but opposite in direction and therefore add to zero. This condition corresponds to the zero crossing of the curve 27 at a point 33 on the $d$ axis. Further movement rightward of the magnet 23 causes the vertical component of the force $F_s$ at the south pole to follow the field lines 31 so as to decrease and eventually reverse its direction so that there is a vertical component of force that is upward at each pole. At some separation of the magnets an optimum distance $d_o$ is reached at which a maximum total vertical component of force exists. Further movement rightward of the magnet 23 diminishes the vertical component of force at each pole. However, since the south pole of magnet 23 is considerably closer to the north pole of magnet 25 than the north pole of magnet 23 is to the south pole of magnet 25, the vertical force $F_{sv}$ predominates and the total vertical force $F_v$ remains repulsive during further rightward movement.

The maximum total vertical component of force on the magnet 23 when it is separated a horizontal distance $d_o$ may be considered to be analogous to the vector 21 (FIG. 2). It should be noted that additional secondary lift is imparted to the magnet 15''' from the repulsive force of the image of magnet 15''''. It should further be noted that a slight attraction exists between the magnet 15''' and the image of magnet 15', but it is found to be so slight that it is neglected for the purposes of the present discussion. Thus with the magnets 15 — 15'''' spaced apart a distance $d_o$ and oriented so that adjacent magnets have fields in opposite directions, significant secondary lift is achieved. As a specific example of the magnitudes of the forces involved, a calculation using permanent magnets, such as the cobalt-rare earth magnets and in particular one made of Co-Pr-Sm with a remanent magnetization of $8.11 \times 10^5$ amperes/meter, a coercive force of ${}_BH_c = 1.0/\mu_o$ and a mass density of $8.5 \times 10^3$ kg/m$^3$, and with a clearance $h$ of 10 cm of the magnets 15' — 15'''' above the track 15, magnets 15' — 15'''' having a radius R of 34.5 cm and a thickness $t$ of 27 cm, yields the result that each magnet will weigh 1890 lbs and will have a net primary lift of 3050 lbs. For 32 magnets, the total net weight of the magnets is 60,500 lbs and the total net primary lift is 97,600 lbs. By arranging the magnets according to the invention, maximum secondary lift may be obtained by spacing the magnets an optimum distance $d_o \doteq 78$ cm. If the magnets are arranged in a single row, the interaction of each magnet with neighboring images can increase the lift of each magnet except an end magnet by 19 percent, thereby permitting a significant reduction in the weight to lift ratio of the system.

Another application of the present invention is in attractive magnetic systems such as used in lifting high magnetic permeability loads, e.g., lifting scrap iron with an electromagnetic device. In this application, a plurality of magnets are used to induce images of the same orientation of magnetic moments in the load to provide primary attraction between the load and lifting magnets; and, as in the magnetic levitation system described, the magnets are spaced apart an optimum distance to provide a maximum secondary attraction between each magnet and the image of an adjacent magnet.

Figure 5:
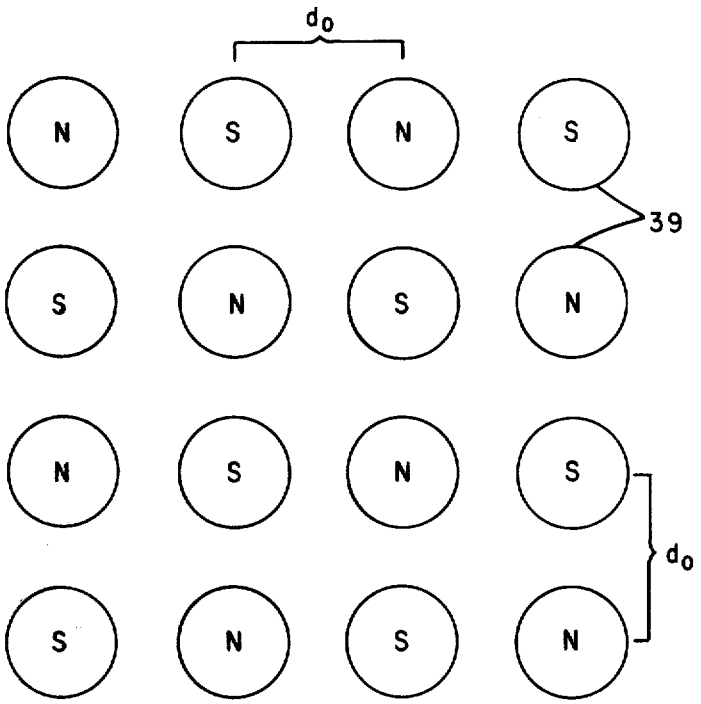
FIG. 5 shows a plurality of magnets arrayed in a checkerboard pattern to provide secondary lift that is greater than that provided in the arrangement shown in FIG. 1.

In accordance with the invention, magnet arrangements other than those discussed hereinbefore are possible. One arrangement of particular value provides even greater secondary effects than the arrangements discussed. Referring to FIG. 5, a plurality of magnets 39 are arrayed in a two-dimensional "checkerboard" pattern wherein the closest magnets are spaced apart the optimum distance $d_o$ discussed hereinbefore. The additional secondary effects are obtained because each of the magnets 39 is adjacent to at least two and as many as four magnets of opposite orientation.

Figure 4:
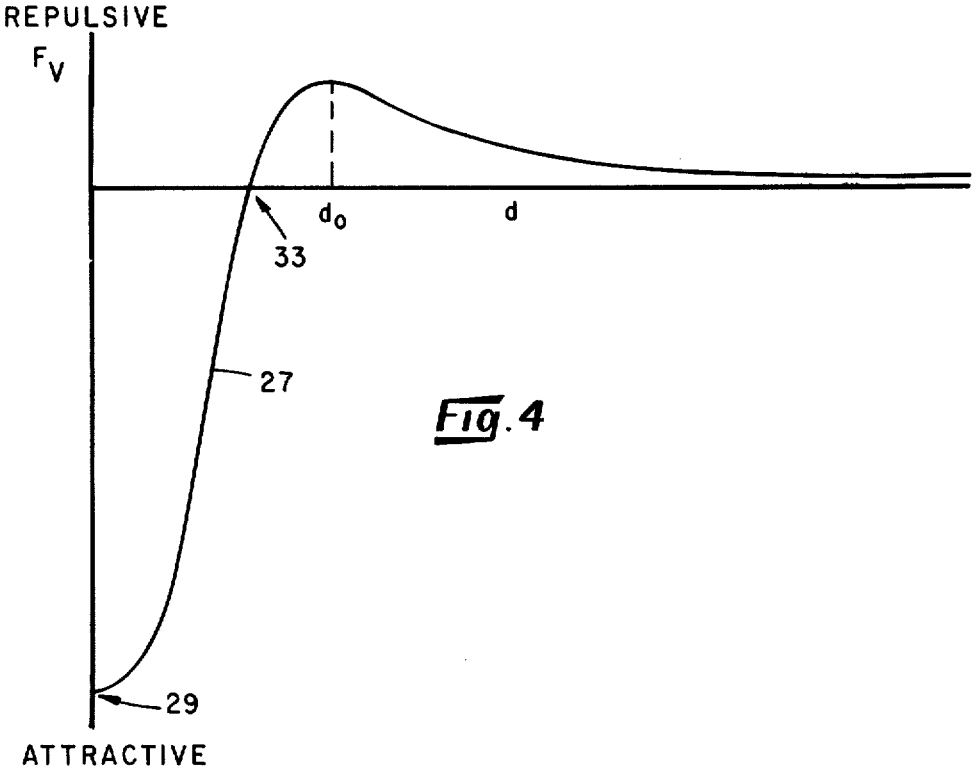
FIG. 4 is a schematic curve representing the total vertical force between the magnets of FIG. 3 as a function of the horizontal separation of the magnets.
Figure 6:
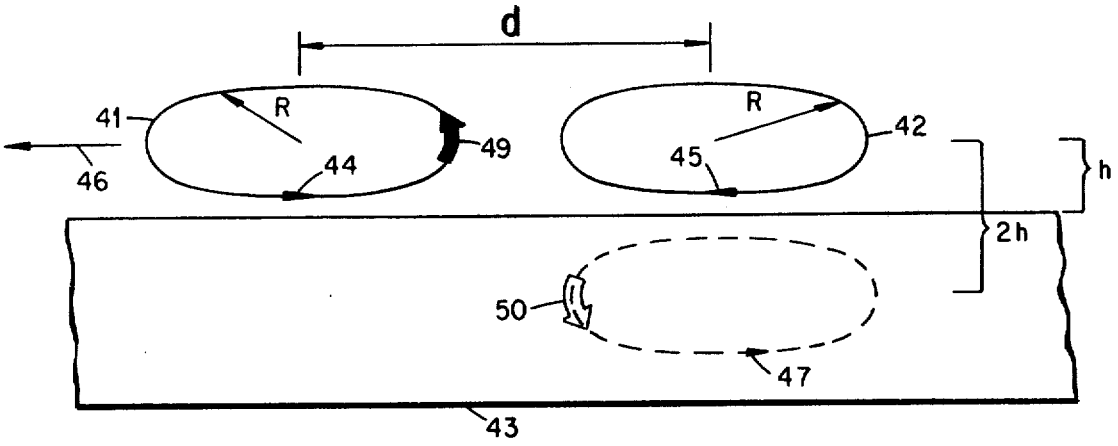
FIG. 6 is a diagram of adjacent first and second current loops and an image current of the first loop to illustrate the concept of secondary lift between the image current of the first loop and the adjacent second loop.

The explanation of FIGS. 3 and 4 hereinbefore presented was chosen for the simplicity of visualization; however, an optimum spacing $d_o$ exists, i.e., the reversal of the sign of the force and its maximization as illustrated in FIG. 4, for a magnet of any thickness. For example, an easily visualized explanation of this effect for the case of adjacent coplanar single conductor loops may be had by reference to FIG. 6, wherein single conductor loops 41 and 42 are shown carrying currents 44 and 45 in opposite directions and moving together relative to a continuous electrically conducting sheet 43 in the direction of arrow 46. The current 45 induces eddy currents in the conducting sheet, the magnetic effect of which can be calculated by assuming an image current loop 47 in the sheet 43. The current loop 47 is a mirror image of the current loop 45 and therefore the loops 45 and 47 may be considered to be spaced equal distances above and below the sheet 43. The current loops 44 and 47 may be divided into segments, including in particular segments 49 and 50, respectively. The segments 49 and 50 are the closest segments of the two loops and since parallel currents in opposite directions repel one another, the segments 49 and 50 repel one another, while segments located ± 90° to the segments 49 and 50 attract one another. Upon integration of the forces between the segments around the periphery of the current loops 44 and 47 the net attraction or repulsion between the loops can be determined. The curve 27 of FIG. 4 is a qualitative representation of the vertical force between the current loops 44 and 47 for a given vertical separation 2h between loop centers as the horizontal distance d between centers is varied. The magnitude of the vertical force between the loops 44 and 47 is a function only of the product of the two currents and the ratios R/h and R/d where R is the radius of the loops. An optimum value of R/h that results in a maximum primary lift force per unit area is given in the aforementioned Cooper et al paper as $R/h = 3.45$. Using this ratio to provide maximum primary lift between loops 45 and 47, the optimum horizontal spacing of the loops is found by means of the calculation outlined to be $d_o = (2.3 \pm 0.3)$ R for maximum secondary lift between the loops 44 and 47.

Figure 7:
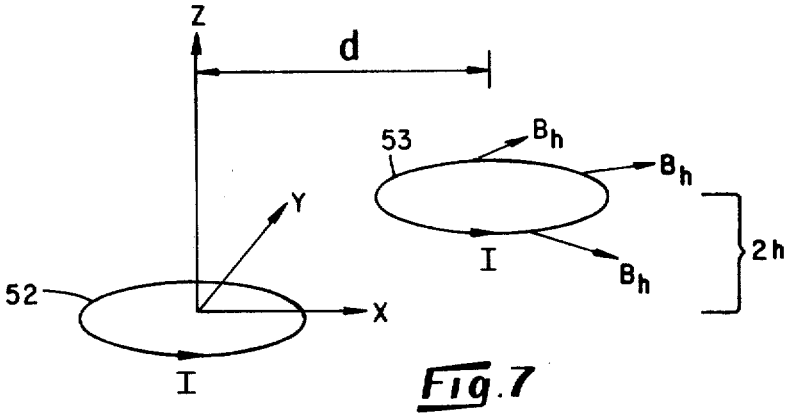
FIG. 7 is a diagram of two current loops and is useful in representing parameters for calculating the lifting force between the loops as a function of their separation.

More specifically, the calculation of the vertical force between two loops carrying current I may be made with reference to FIG. 7 in which a first current loop 52 is shown lying in the $x$-$y$ plane, $z = o$, and a second current loop 53 is shown lying in a parallel plane $z = 2h$. The loop 52 may be considered to be a mirror image current in a continuous electrically conductive sheet of a directly opposite inducing current (not shown) lying in the plane $z = 2h$, coplanar with the loop 53. Calculation of the vertical force between the loops 52 and 53 for all distances d between the center of the loops will provide data for plotting a curve 27 (FIG. 4) that indicates that there is secondary lift and that there is an optimum distance $d_o$ that maximum secondary lift exists. Such calculations of the vertical force between the loops 52 and 53 may be accomplished by using the law of Biot and Savart to find the horizontal component of magnetic induction $\vec{B}_h$ by the loop 52 on the loop 53. The equation of Biot and Savart for $\vec{B}_h$ may be integrated over loop 52 as the source at every point on the periphery of loop 53. Then using the Ampere force law expression for incremental force, in the form $d\vec{F}_v = I\, dl\, (\hat{t} \times \vec{B}_h)$ (vector cross product) where $\hat{t}$ is a unit vector tangent to the periphery of loop 53 and dl is an incremental length along the periphery of loop 53, and taking the vertical ($z$-) component at every point on the periphery of loop 53, the expression for incremental vertical force is integrated along the entire periphery of loop 53. Repeated integrations of the Biot and Savart equation and the Ampere force law expression for a large number of values of the separation d provides values of secondary lifting force between the loops 52 and 53 as a function of the separation d to plot a curve having a general shape corresponding to the curve 27 (FIG. 4) that indicates the horizontal separation $d_o$ of the loops 52 and 53 at which the maximum vertical repulsive force $F_v$ exists.

Figure 8:
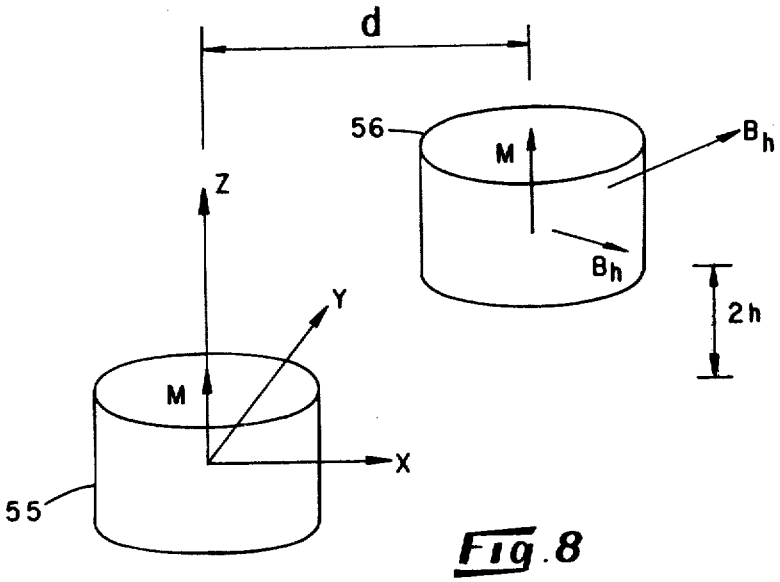
FIG. 8 is a diagram of two permanent magnets and is useful for representing parameters for calculating the lifting force between the magnets as a function of their separation.

The calculation of the vertical force to show secondary lift between two uniformly magnetized permanent magnets 55 and 56 may be made with reference to FIG. 8 in which the magnets 55 and 56 are coaxial, are separated a distance $2h$, and the nearest poles are of opposite polarity. Calculation of the vertical force between the magnets 55 and 56 may be accomplished by using the law of Biot and Savart to find the horizontal component of magnetic induction $\vec{B}_h$ by the magnet 55 at a point on the surface of magnet 56. The equation of Biot and Savart for $\vec{B}_h$ may be integrated over the surface of magnet 55, with $\vec{M} \times \vec{n}$ as the surface current density, where $\vec{M}$ is the magnetic moment per unit volume and $\vec{n}$ is the unit vector pointing normally outward from the surface at any given surface point, to give the horizontal component of magnetic induction, $\vec{B}_h$, as a total of the induction of all of the points on the surface of the magnet 56. Then using the Ampere force law expression for incremental force in the form $$\vec{d^2F} = dA\ (\vec{M} \times \vec{n}) \times \vec{B}_n$$

where dA is an element of area on the surface of magnet 56 and $n$ is the unit vector pointing normally outward therefrom, integrate the expression for the entire surface of magnet 56 using the vertical component of the incremental force. Repeated integrations of the Biot and Savart equation and the Ampere force law expression for a large number of values of the separation d between the magnets 55 and 56 provides values of secondary lifting force between magnets 55 and 56 as a function of the separation $d$ to plot a curve having a general shape corresponding to the curve 27 (FIG. 4) that indicates the horizontal separation $d_o$ of the magnets 55 and 56 at which the maximum vertical repulsive force $F_r$ exists.

It is to be noted that all of the foregoing calculations are rigorously true only for a continuous electrically conductive plane of large extent that is oriented in a direction transverse to the magnetic material, but the calculation will be quite close to those actually obtained in practice.

It is to be further noted that at speeds in excess of 100 mph, the primary consideration for optimizing lift is geometrical in nature, the conductivity of the conducting sheet being of secondary significance, as opposed to the scheme set forth in the aforementioned Powell, Jr. et al patent wherein the electrical characteristics of the track are of primary importance.

While an embodiment of the invention has been shown and described, further embodiments or combinations will be apparent to those skilled in the art without departing from the spirit of the invention.

What I claim is:

1. In a system for magnetic levitation of a high-speed vehicle, the combination of:

a sheet of continuous nonferromagnetic electrically conductive material;

a plurality of magnets for producing a corresponding plurality of magnetic fields;

means for securing said magnets in said vehicle in positions adjacent said sheet so as to direct said fields to penetrate said sheet; and means for propelling said vehicle with respect to said sheet to cause said fields to induce eddy currents that repel the inducing magnets to thereby provide primary lift for said vehicle to raise it above said sheet;

said plurality of magnets being oriented so that adjacent magnets direct fields of unlike polarities into said sheet, said plurality of magnets being spaced apart an optimum distance at which there is a maximum vertical repulsive force between each magnet and the induced eddy currents due to an adjacent magnet to thereby provide secondary lift for said vehicle;

said plurality of magnets being cylindrical and the ratio of said optimum distance to the radius of said magnets being $2.3 \pm 0.3$.

2. The combination of claim 1, wherein said sheet is formed into a u-shaped track in which said magnets are centrally located, said induced eddy currents extending into the vertically oriented sides of the u-shaped track to provide lateral forces that tend to maintain the magnets centered in the track.

3. The combination of claim 1, wherein said plurality of magnets are superconducting magnets.

4. The combination of claim 1, wherein said plurality of magnets are cryogenic magnets.

5. The combination of claim 1, wherein said plurality of magnets are permanent magnets.

6. The combination of claim 5, wherein said permanent magnets are cobalt-rare earth magnets and made of Co-Pr-Sm.

7. The combination of claim 6 wherein each of said magnets have a remanent magnetization on the order of $8.11 \times 10^5$ amperes/meter, a coercive force of ${}_BH_c = 1.0/\mu_o$ amperes/meter ($\mu_o = 4\pi \cdot 10^{-7}$), a mass density of $8.5 \times 10^3$ kg/m$^3$, a radius of 34.5 cm, a thickness $t$ of 27 cm and are spaced apart an optimum distance $d_o = 78$ cm to provide optimum secondary lift.

8. The combination of claim 1, wherein said plurality of magnets are arranged in a checkerboard pattern.

9. The combination of claim 1, wherein said vehicle is operable to move at a speed greater than 100 mph.

* * * * *